US006024585A

United States Patent [19]

Mickievicz et al.

[11] Patent Number: 6,024,585

[45] Date of Patent: Feb. 15, 2000

[54] METHOD FOR CONNECTING A LOOP ANTENNA

[75] Inventors: Scott Keith Mickievicz, Elizabeth; Richard Nicolas Whyne, Mechanicsburg, both of Pa.; Scott Frederick Morin, Fort Lauderdale, Fla.; Jennifer Lyn Peavy, Cordova, Tenn.; Robert Thomas Hirsbrunner, Hummelstown, Pa.

[73] Assignee: The Whitaker Corporation, Wilmington, Del.

[21] Appl. No.: 09/151,563

[22] Filed: Sep. 11, 1998

Related U.S. Application Data

[60] Provisional application No. 60/058,621, Sep. 11, 1997, provisional application No. 60/073,063, Jan. 20, 1998, and provisional application No. 60/090,986, Jun. 29, 1998.

[51] Int. Cl.[7] ..... H01R 9/09

[52] U.S. Cl. ..... 439/83; 343/702

[58] Field of Search ..... 29/600; 439/81, 439/83, 853, 814; 343/870, 906, 744

[56] References Cited

U.S. PATENT DOCUMENTS

| | | | |
|---|---|---|---|
| 4,720,770 | 1/1988 | Jameson | 361/705 |
| 4,869,673 | 9/1989 | Kreinberg et al. | 439/64 |
| 4,889,500 | 12/1989 | Lazar et al. | 439/579 |
| 5,113,196 | 5/1992 | Leon et al. | 343/744 |
| 5,539,416 | 7/1996 | Castaneda et al. | 343/702 |
| 5,713,767 | 2/1998 | Hanson et al. | 439/853 |
| 5,767,813 | 6/1998 | Verma et al. | 343/744 |

*Primary Examiner*—Khiem Nguyen
*Assistant Examiner*—Michael C. Zarroli

[57] ABSTRACT

A method for connecting two ends (34, 36) of a conductive member (32) to a circuit-bearing article (20) includes the steps of: selecting a conductive member (32) having two ends (34,36) adapted to be terminated to receptacles; selecting at least two heat-insensitive terminals (40), electrically connecting the terminals (40) to a respective circuit terminus (24) with a selected amount of fluid conductive material; and mating the conductive member ends (34, 36) to respective receptacles (44) of the terminals (40).

17 Claims, 8 Drawing Sheets

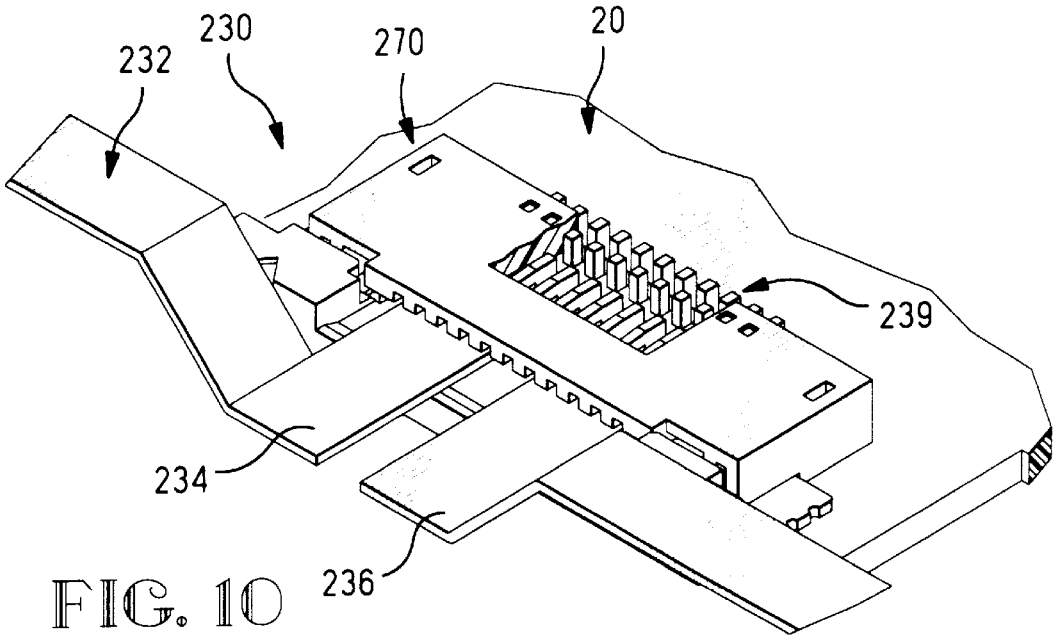
FIG. 10
FIG. 11
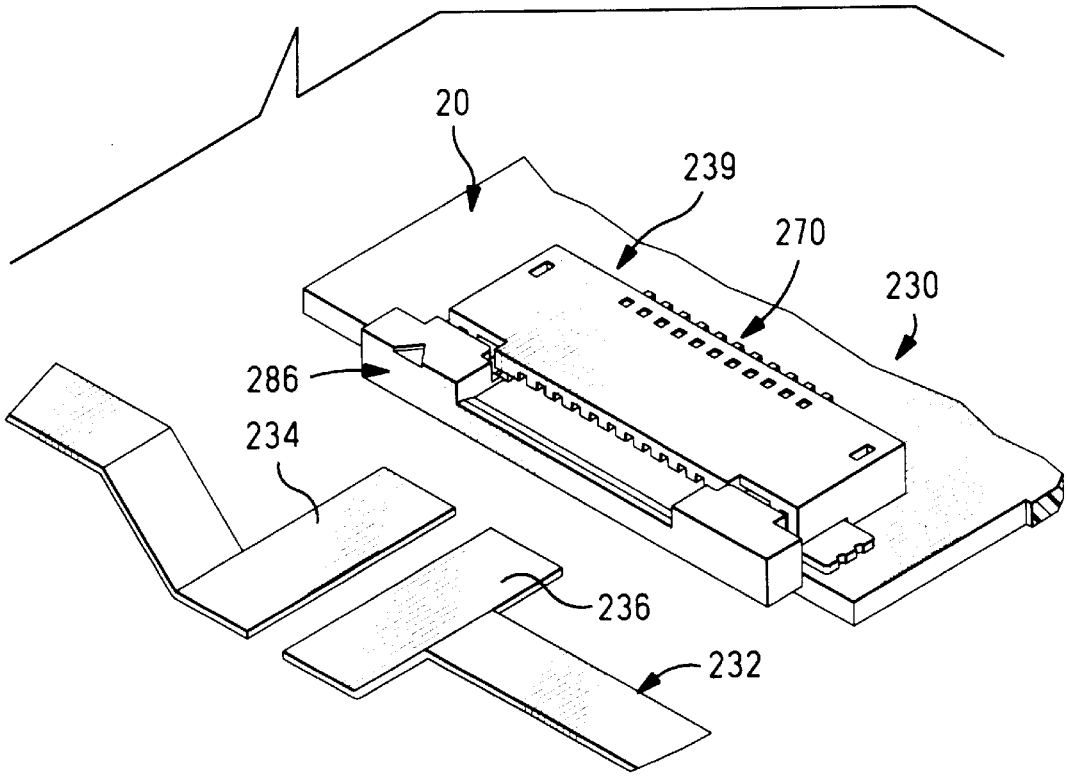

METHOD FOR CONNECTING A LOOP ANTENNA

This application claims the benefit of U.S. Provisional Application(s) No.(s) 60/058,621, filed Sep. 11, 1997; 60/073,063, filed Jan. 20, 1998; and 60/090,986, filed Jun. 29, 1998.

FIELD OF THE INVENTION

This invention is directed to electrical assemblies having loop antennae and more particularly to a method for connecting a loop antenna to a circuit-bearing article.

BACKGROUND OF THE INVENTION

The use of loop antennaes in electrical devices is well known. In larger devices typically the ends of the antenna are secured by screws or other fasteners to a chassis or backplane. With smaller devices, such as pagers, personal communication system devices, or the like the loop antenna is relatively small, typically on the order of 10–15 millimeters wide by 40–60 millimeters long. Thus, another method is needed to secure the ends of the antenna to the circuit-bearing article.

One way of attaching the ends of small loop antennaes is by hand soldering such as shown in FIG. 1. This method is labor intensive, and the amount of solder used to attach the ends as well as the location of the solder on the ends and the distance between the deposits of solder can vary from assembly to assembly. The resultant electrical characteristics of the loop antennaes, therefore, may vary. It is well known in the industry that it is desirable to match the impedance of the antenna and the impedance of the electrical article to which an antenna is connected to minimize signal reflections during the operation of the device. Any changes in the electrical characteristics of the loop antenna as a result of variability in the hand soldering process can cause changes in the signal reflections between the antenna and the circuit-bearing article.

SUMMARY OF THE INVENTION

The present invention is directed to an interconnection arrangement between a circuit-bearing article and a conductive member and to a method for connecting two ends of a conductive member to a circuit-bearing article resulting in a controlled impedance connection that eliminates problems associated with the prior art.

The conductive member has two ends that are adapted to be electrically connected to respective circuit termini of the circuit-bearing article at a selected impedance. The two ends of the conductive member are adapted to be mated to receptacles. The circuit-bearing article includes at least two terminals of heat-insensitive construction, each terminal being electrically connected to respective circuit termini of the circuit-bearing article using selected amounts of fluid conductive material. Each terminal includes a receptacle for electrical connection to a respective end of the conductive member upon insertion of the ends thereinto. The ends of the conductive member are terminated to the respective termini of the circuit-bearing article upon insertion of the ends into the receptacles after completion of processes involving elevated temperature to secure articles to the circuit-bearing article.

The method for connecting two ends of a conductive member to a circuit-bearing article resulting in controlled impedance comprises the steps of: selecting a conductive member having two ends adapted to be mated to receptacles, the conductive member having a selected impedance; selecting at least two terminals of heat-insensitive construction, each terminal having a connecting section for electrical connection to a circuit terminus of the circuit-bearing article and a receptacle adapted to engage one of the ends of the conductive member; disposing a selected amount of a fluid conductive material on each of the circuit terminus; positioning the terminals on a respective terminus; electrically connecting the connecting section of the terminals to a respective the circuit terminus of article; and mating the ends of the conductive member to respective ones of the receptacles. The conductive member is affixed to the circuit-bearing article after performance of all processes involving elevated temperature to secure articles to the circuit-bearing article. For purposes of illustration, the invention is shown as a loop antenna terminated to a circuit board. The loop antenna has two ends and a selected impedance, and the circuit-bearing article has two termini for interconnection to ends of the antenna. Upon mating each of the two ends of the antenna to respective terminating sections of the terminals, signal reflections between the conductive member and the circuit-bearing article are minimized. The invention provides a method that is repeatable in that the articles produced by the method have a precise amount of conductive material, thus eliminating problems associated with hand soldering or the like. It is to be understood that both ends of the loop antenna may be blade-like and that the terminating section of both terminals are receptacles.

The invention is also directed to a connector for use in connecting an antenna to a circuit board. The connector includes at least two terminals and a housing. In the examples shown, the ends of the antenna are blade-like and the terminating sections of the terminals are receptacles adapted to receive the blade-like antenna ends. The terminals are secured together by means of an insulative housing that isolates the terminals from one another but holds them together as a unit. The housing further provides guidance for inserting the ends of the antenna into the respective terminals. The housing has a flat top surface that facilitates automatic processing by the use of vacuum pick and place equipment to position the housing and terminals on the circuit termini. A selected amount of conductive material such as solder or conductive adhesive or the like is disposed on each of the circuit termini. The at least two terminals are connected to respective termini on the circuit board that are substantially parallel to one another. The terminals may be a surface mountable or a through-hole design. The terminals may be secured to the termini at the same time other components are being mounted to the circuit board, by using a solder reflow process or other processes involving elevated temperatures used to affix electrical articles to a circuit board (e.g., soldering, welding, etc.). It is to be understood that the term "solder", as used herein, also includes conductive adhesives or the like, as known in the art. In one example of the connector, the housing is clip-like and the terminals are stamped and formed members, each having an upstanding rear wall and a pair of rolled portions having free ends extending toward the wall and defining a blade-receiving slot therebetween. Each terminal further includes a retention tab spaced from the rolled sections and defines a housing-retention slot therebetween.

In another example of the connector, the housing is essentially H-shaped defining a pair of terminal receiving cavities. The terminals are stamped and formed members, each having an upstanding wall and a single rolled portion defining a blade-receiving slot therebetween.

In a further embodiment, the housing is elongated and includes a plurality of blade-receiving terminals. When the antenna is assembled to the connector, each blade-like end of the antenna engages a plurality of terminals. In this embodiment the ends of the antenna enter the housing essentially parallel to the circuit board. To provide additional support to the antenna, the housing may further include a support plate.

Embodiments of the invention will now be described with reference to the accompanying drawings.

BRIEF DESCRIPTION OF THE DRAWINGS

FIG. 10 is an isometric view of a further embodiment of the assembly made in accordance with the invention.

FIG. 11 is a fragmentary portion of FIG. 10 with the antenna exploded from the connector.

DETAILED DESCRIPTION OF EMBODIMENTS OF THE INVENTION

For purposes of illustration the invention will be described with reference to a loop antenna terminated to a circuit-bearing article, shown as a circuit board of an electrical article, such as a pager, personal communication device or the like.

Figure 1:
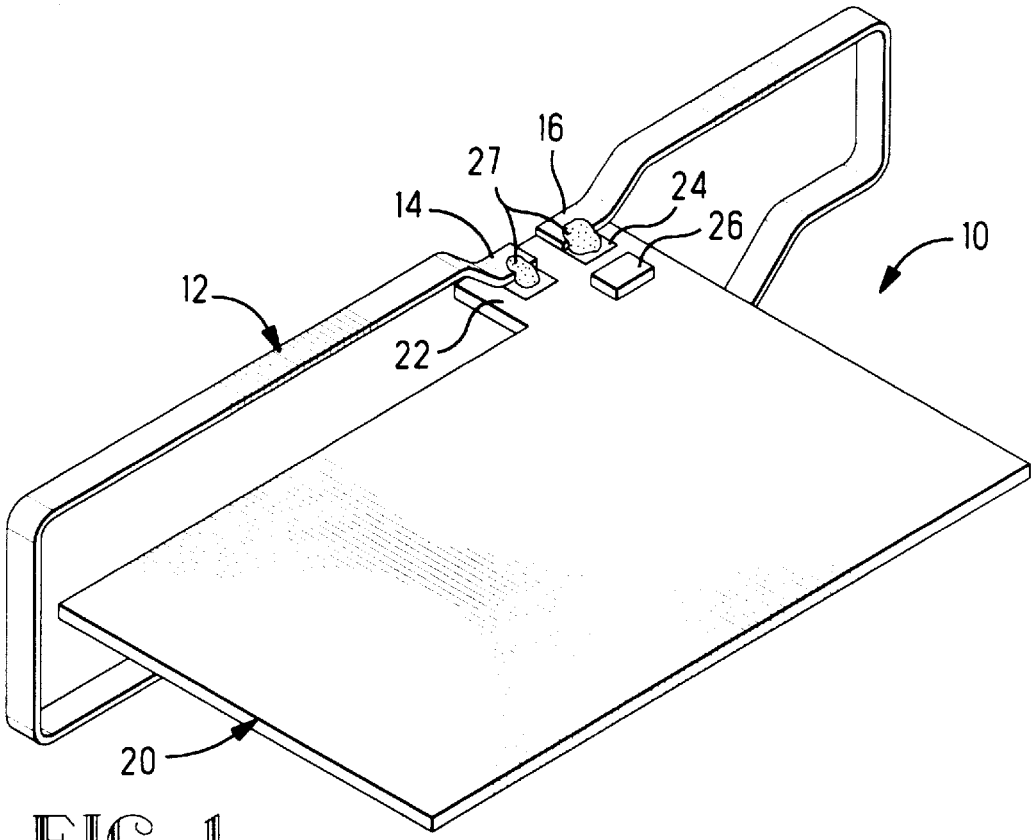
FIG. 1 Prior Art
FIG. 1 is an isometric view of a prior art assembly.
Figure 2:
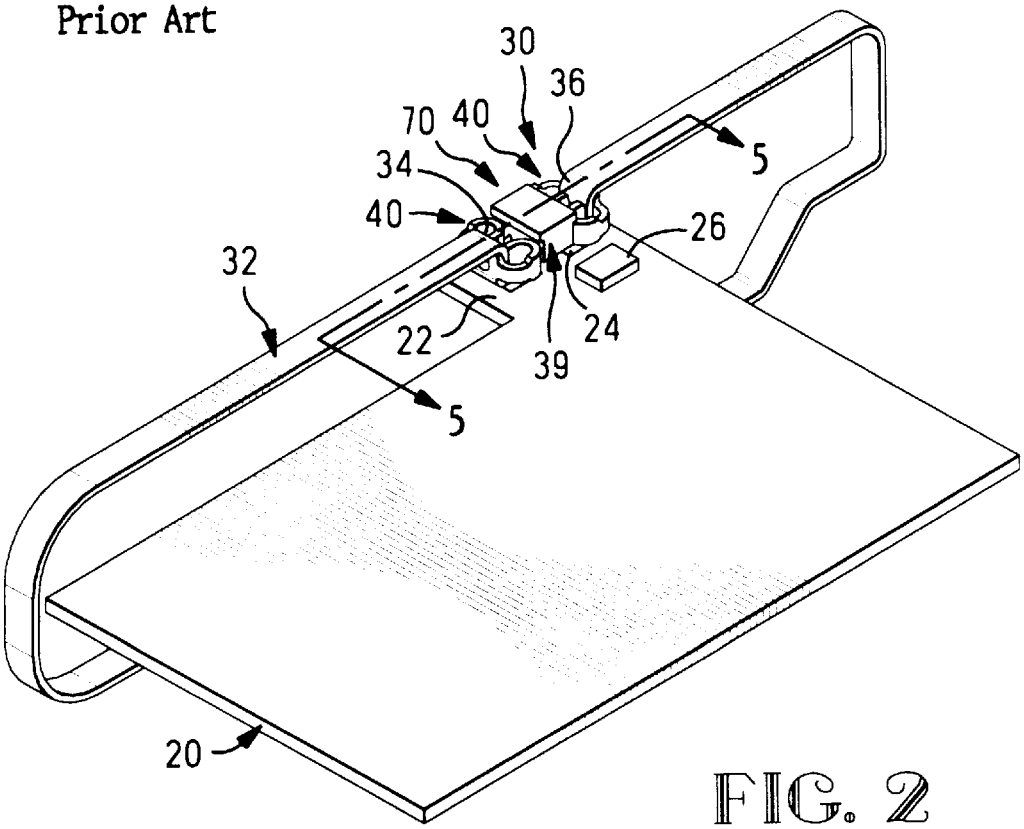
FIG. 2 is an isometric view of one embodiment of the assembly made in accordance with the invention.
Figure 3:
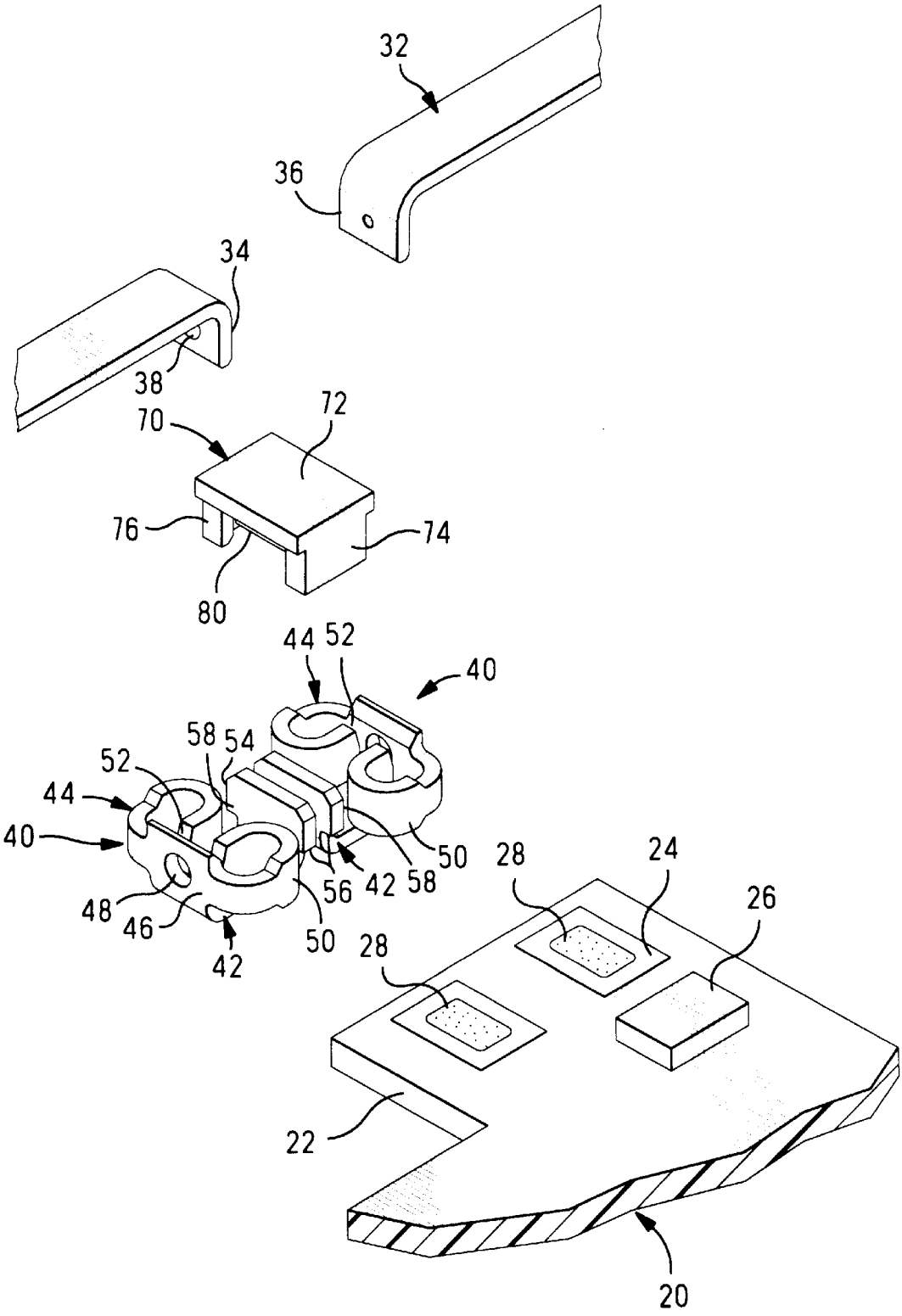
FIG. 3 is a fragmentary portion of FIG. 2 with the parts exploded from one another illustrating the attachment of the conductive member to the circuit-bearing article.

FIG. 1 illustrates a prior art assembly 10 having a loop antenna 12 terminated to a circuit board 20. The ends of the loop antenna 14, 16 are hand soldered to respective termini 24 on an extension 22 of the circuit board 20. For purposes of illustration the circuit board is shown with a component 26. It is to be understood that the circuit board would typically have a plurality of circuit and a plurality of components mounted thereon. In accordance with the prior art solder 27 is applied manually to the ends 14, 16 to connect the ends to the respective termini 24. The amount of solder 27 can vary between one assembler and another as well as from one assembly to another. The differences in the amounts and position of the solder will change the characteristics of the antenna thus affecting the signal reflections between the antenna and the circuit board.

One embodiment 30 of the present invention is illustrated in FIG. 2 through 5. For purposes of illustrating the assembly 30, the same circuit board 20 having an extension 22 and circuit termini 24 thereon will be used to describe the method for attaching an antenna 32 in accordance with the present invention. Assembly 30 includes an antenna 32, and connector 39 including two terminals 40 and an insulative clip-like housing 70 and circuit board 20. The antenna 32 includes first and second ends 34, 36, that, in the embodiment shown, have blade-like portions. Ends 34, 36 further include outwardly extending protrusions 38 that are used in securing the ends in respective terminals 40, as described below. The ends 34, 36 are spaced apart a selected distance. The antenna 32 is made from material such as beryllium copper or the like, as known in the art.

Figure 5:
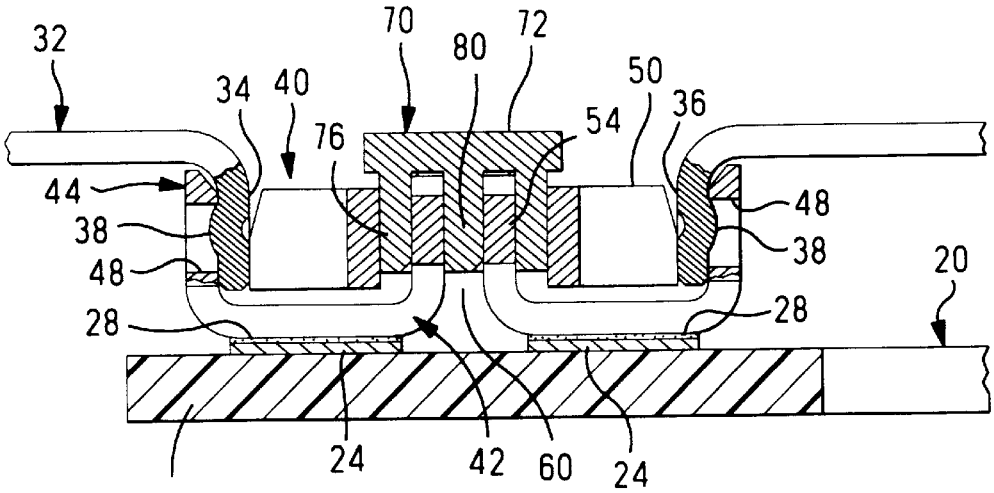
FIG. 5 is a cross-sectional view taken along line 5—5 of FIG. 2 and illustrating the terminals secured to the circuit-bearing article and the antenna ends terminated thereto.
Figure 6:
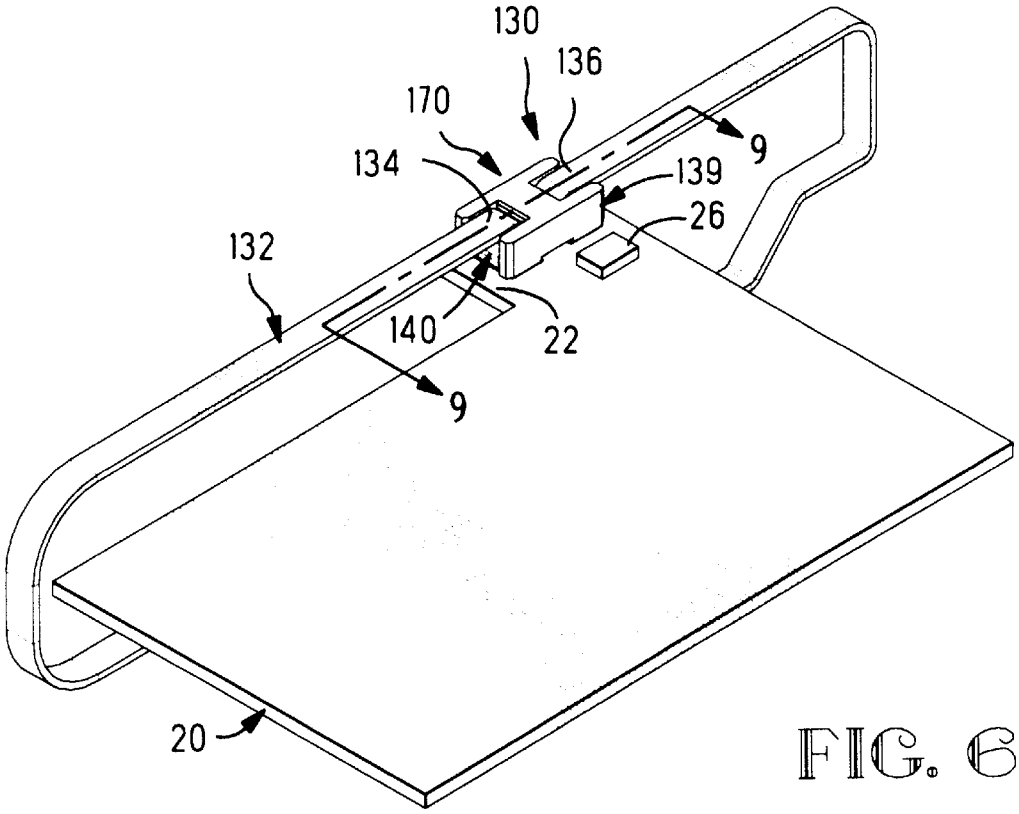
FIG. 6 is an isometric view of another embodiment of the assembly made in accordance with the invention.

Each terminal 40 is a stamped and formed member having a connecting section 42 adapted to be electrically connected to a respective terminus 24 of the circuit board 20, and a terminating section 44 adapted to receive one of the blade-like ends 34, 36 of the antenna 32. As best seen in FIG. 5, terminals 40 are spaced from one another by a selected distance 60. The terminating section 44 includes an upstanding rear wall 46 having a pair of rolled portions 50 having free ends 51 extending toward the wall 46 and defining a blade-receiving slot 52 between ends 51 and wall 46. Terminal 40 further includes a retention tab 54 spaced forwardly from the resilient rolled sections 50 and defining a housing-retention slot 58 between sections 50 and tab 54. The retention tabs 54 include barbs 56 which engage inner surfaces of the side extensions 76 to hold the housing 70 and terminals 40 securely together.

Figure 4:
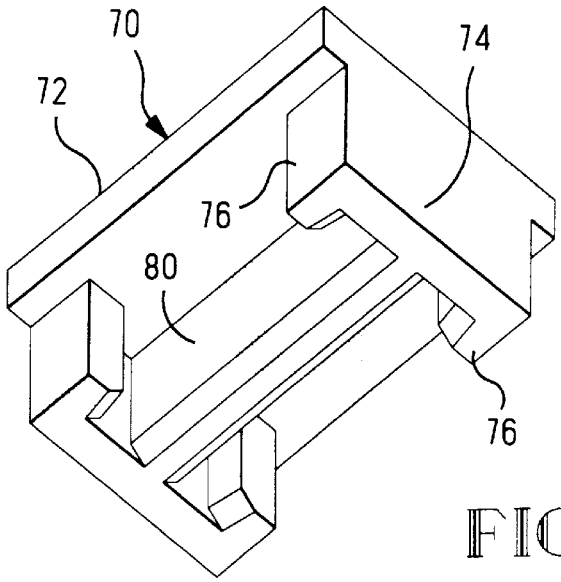
FIG. 4 illustrates the structure of the housing of FIG. 3 that secures the terminals together.

The housing 70, as best seen in FIGS. 4 and 5, has a top surface 72, opposed end walls 74 each having side wall extensions 76 extending partially along each side of the housing 70, and a central wall 80 extending between the end walls 74. Wall 80 is dimensioned to be received within the distance 60 defined between the respective terminals 40 with the side extensions 76 extending into the respective retention slots 58 to secure the two terminals 40 in position.

In accordance with the present invention, a selected amount of solder 28 can be precisely placed on the respective termini 24 on board 20. Thus, each assembly 30 has essentially the same amount of solder placed in a precise location on the termini 24. The terminals 40 with the housing 70 mounted thereto can be automatically positioned on the circuit board termini 24 with the use of vacuum pick and place or other such equipment. The terminals 40 and housing 70 are permanently secured to the circuit board 20 at the same time the remaining components, shown representatively as 26, are secured to the board in reflow soldering process, as known in the art. After the terminals 40 have been secured to the board 20, the ends 34, 36 of the antenna 32 can be inserted into the blade-receiving slots 52 of the terminals 40 thus completing the assembly. As best seen in FIG. 5, each ends 34, 36 of the antenna 32 further includes a protrusion 38 that is received into a respective retention aperture 48 in the upstanding walls 46 of the terminals 40 thus holding the ends 34, 36 of the antenna 32 securely in place.

Another embodiment 130 of the present invention is illustrated in FIG. 6 through 9. The same circuit board 20 will also be used to describe this embodiment. Assembly 130 includes an antenna 132, and connector 139 including two terminals 140 and an insulative H-shaped housing 170, and circuit board 20. The antenna 132 includes first and second ends 134, 136, which in the embodiment shown, have blade-like portions. Antenna 132 is substantially identical to antenna 32 except that protrusions 138 on ends 134, 136 extend in the opposite direction to that of protrusions 38.

Figure 9:
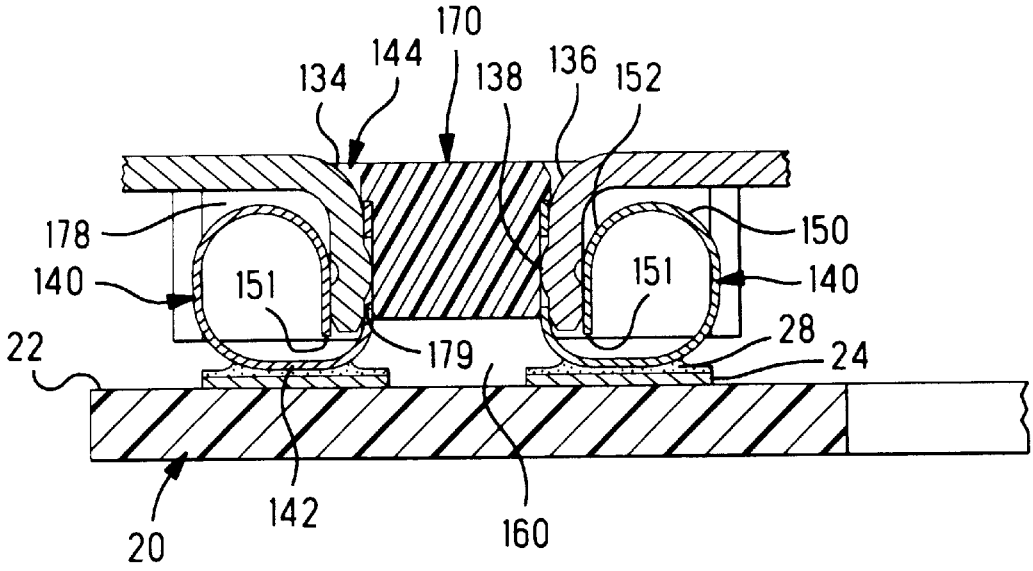
FIG. 9 is a cross-sectional view taken along line 9—9 of FIG. 6 and illustrating the terminals secured to the circuit-bearing article and the antenna ends terminated thereto.

Each terminal 140 is a stamped and formed member having a connecting section 142 adapted to be electrically connected to a respective terminus 24 of the circuit board 20, and an antenna connecting section 144 adapted to receive one of the blade-like ends 134, 136 of the antenna 132. As best seen in FIG. 9, terminals 140 are spaced from one another by a selected distance 160. The antenna-connecting section 144 includes an upstanding rear wall 146 having a single rolled portion 150 having a free end 151 extending toward the board connecting section 142 and defining a blade-receiving slot 152 between rolled surface 150 and wall 146. Wall 146 further includes barbs 156 which engage inner surfaces of housing walls 174 to hold the housing 170 and terminals 140 securely together.

Figure 7:
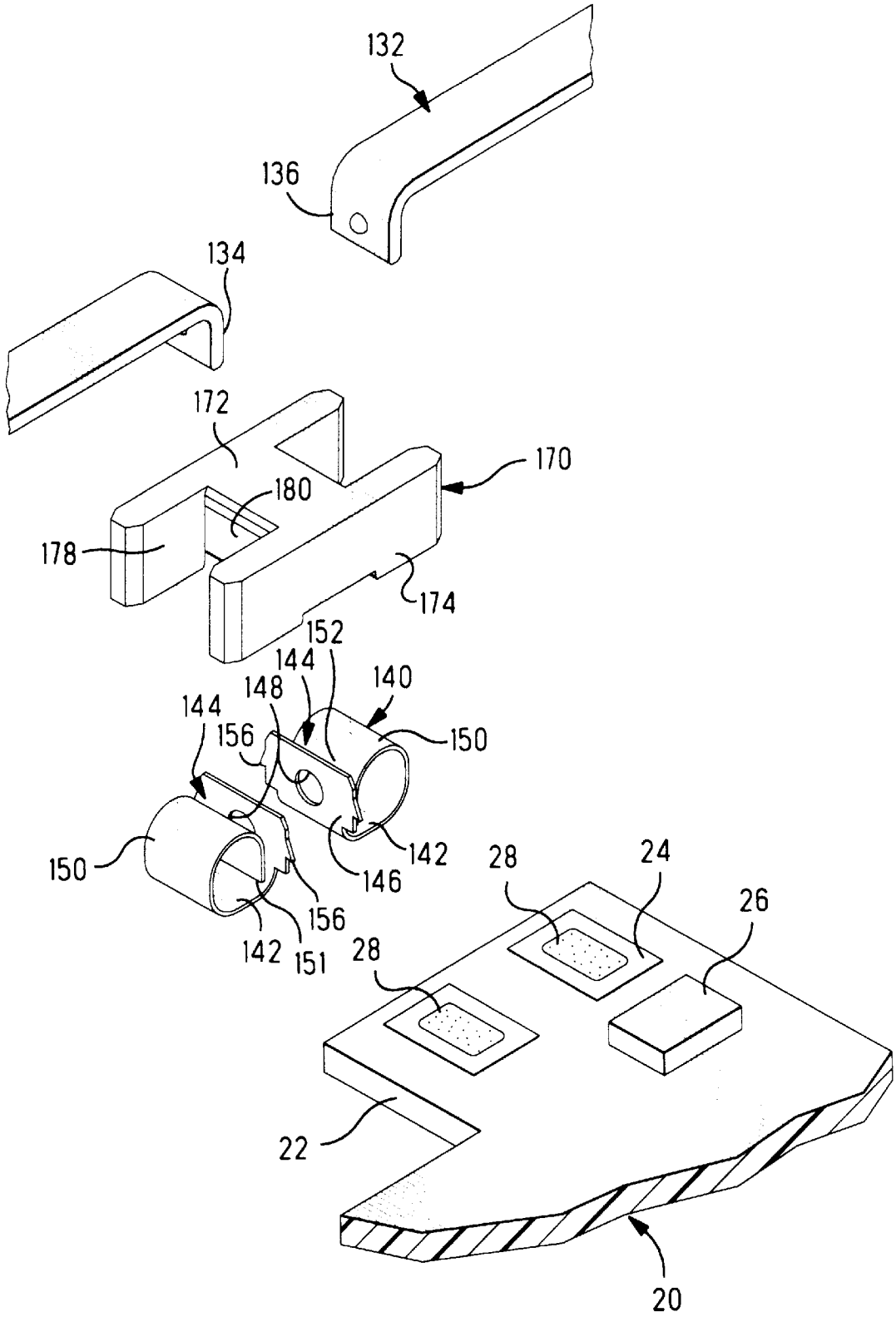
FIG. 7 is a fragmentary portion of FIG. 6 with the parts exploded from one another illustrating the attachment of the conductive member to the circuit-bearing article.
Figure 8:
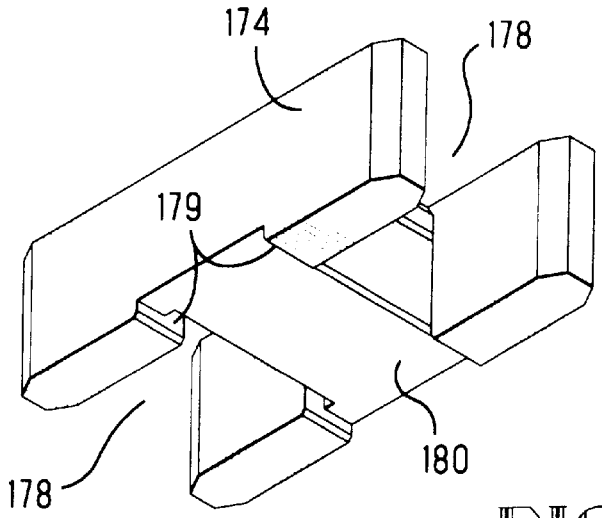
FIG. 8 illustrates the structure of the housing of FIG. 7 that secures the terminals together.

The housing 170, as best seen in FIGS. 7, 8 and 9, has a top surface 172, opposed side walls defining terminal-receiving cavities 178, and a central wall 180 extending between the side walls 174. Wall 180 further defines a terminal-receiving slot dimensioned to receive terminal walls 146 therein.

As previously described, a precise selected amount of solder 28 can be precisely placed on the respective termini 24 on board 20. Connector 139 including terminals 140 and housing 170 can be automatically positioned on the circuit board termini 24 with the use of vacuum pick and place or other such equipment. After the terminals 140 have been secured to the board 20, the ends 134, 136 of the antenna 132 can be inserted into the blade-receiving slots 152 of the terminals 140 thus completing the assembly. As best seen in FIG. 9, protrusions 138 are received into respective retention apertures 148 in the upstanding walls 146 of the terminals 140 thus holding the ends 134, 136 of the antenna 32 securely in place.

Figure 12:
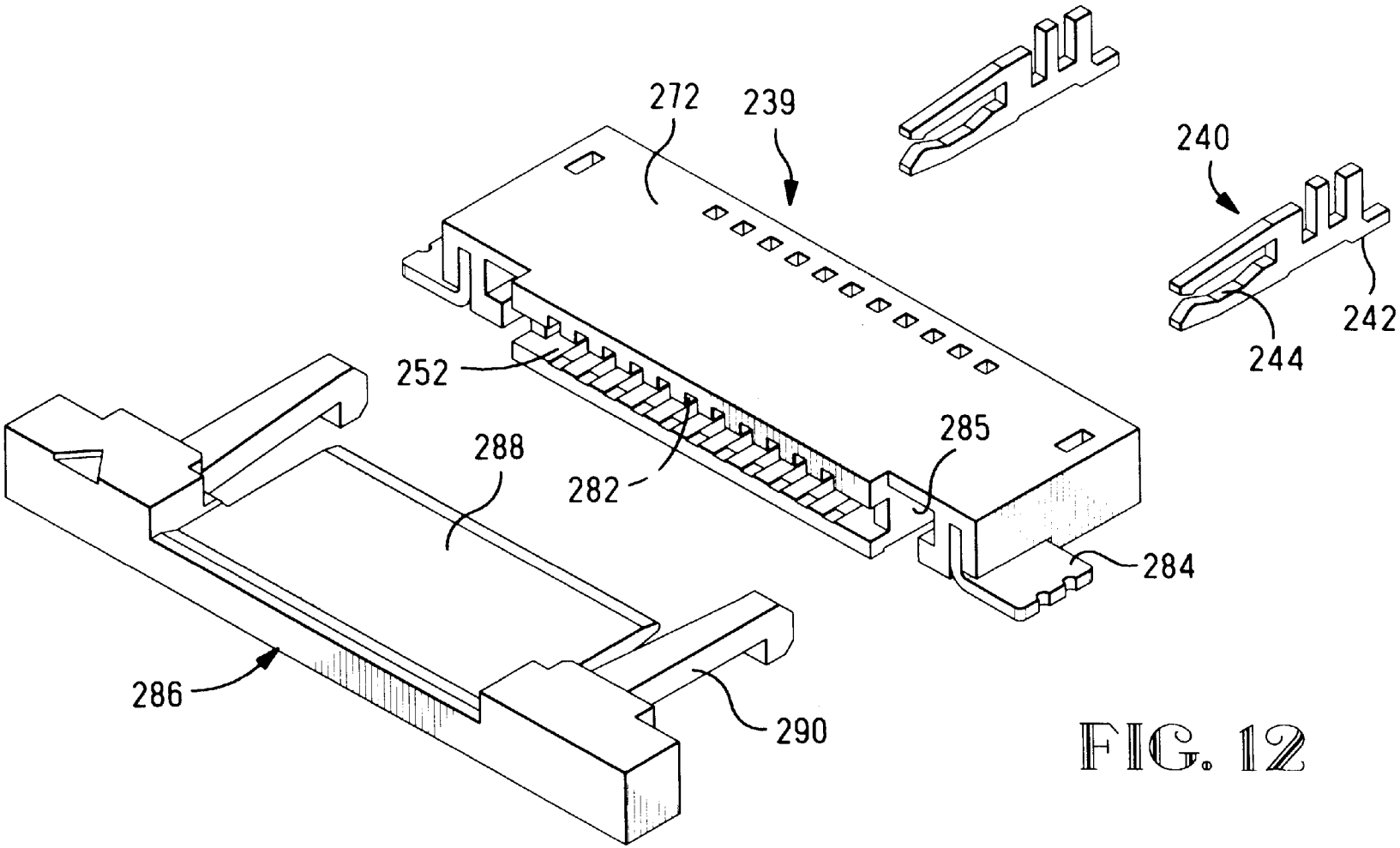
FIG. 12 is an isometric view of the connector with the parts exploded from one another.

A further embodiment 230 of the present invention is illustrated in FIG. 10 through 12. The same circuit board 20 will also be used to describe this embodiment. Assembly 230 includes an antenna 232, and connector 239 including a plurality of terminals 240 and an insulative housing 270, and circuit board 20. The antenna 232 includes first and second ends 234, 236, which in the embodiment shown, have blade-like portions. Antenna 232 is substantially identical to antennas 32, 132 except that the first and second ends 234, 236 extend substantially at a right angle to the loop.

Each terminal 240 is a flat stamped member having a connecting section 242 adapted to be electrically connected to a respective terminus of the circuit board 20, and an antenna connecting section 244 adapted to receive one of the blade-like ends 234, 236 of the antenna 232. As best seen in FIG. 12, housing 270 includes a plurality of terminals 240. The antenna connecting section 244 is fork shaped.

The housing 270, as best seen in FIG. 12, has a top surface 272, an antenna-receiving face 282, a plurality of terminal-receiving cavities 278, and a blade-receiving slot 252. Connector 239, as illustrated, further includes a support plate 286 having a plate-like portion 288 adapted to provide support to antenna ends 234, 236. Support plate 286 is secured to housing 270 by means of latching arms 290, which are received and retained in apertures 285. Mounting brackets 284 are secured in housing 270 and are used to secure connector 239 to circuit board 20 by solder, adhesive, or other mounting devices as known in the art.

As previously described, a precise selected amount of solder 28 can be precisely placed on the respective termini on board 20 and connector 239 including terminals 240 and housing 270 can be automatically positioned on the circuit board after which the ends 234, 236 of antenna 232 can be inserted into slot 252. In this embodiment, each antenna end 234, 236 is electrically engaged to a plurality of terminals 240. As can be seen from FIG. 10, the antenna ends 234, 236 are spaced from one another when in slot 252.

The entire assembly process is repeatable and the characteristics of the antennas of the resultant assemblies 30, 130, 230 are substantially identical. The selected distances between the termini 24, the distance between the terminals 40, 140, 240 and the location and amount of conductive material are selected to minimize any signal reflections between the antennas 32, 132, 232 and the circuit board. The invention is suitable for terminating any loop antennas having ends adapted to be mated to terminals on a circuit-bearing article. In the embodiments shown, the antennas ends have blade-like sections and the terminals are blade-receiving receptacles. It is to be understood that the antenna ends and terminals are not limited to these shapes.

The present invention provides an assembly process that uses a precise amount of conductive material to secure terminals 40, 140 to the circuit board thus enabling precise control of both the impedance of the circuit board assembly and the antenna. This minimizes signal reflections between the antenna and the circuit board 20. The entire process can be automated thus eliminating manual labor and inconsistency in soldering each antenna end. The use of a housing with a flat upper surface facilitates the use of pick and place equipment.

It is thought that the antenna assemblies and the method of connecting the antenna to a circuit-bearing article of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. An interconnection arrangement between a circuit-bearing article and a conductive member having two ends that are adapted to be electrically connected to respective circuit termini of the circuit-bearing article at a selected impedance, comprising:

at least two terminals of heat-insensitive construction electrically connected to respective circuit termini using selected amounts of fluid conductive material, each said terminal including a receptacle for electrical connection to a respective end of the conductive member upon insertion of the ends thereinto, whereby the conductive member ends are terminated to the respective termini of the circuit-bearing article upon insertion of the conductive member ends into the receptacles after completion of processes involving elevated temperatures to affix other electrical articles to the circuit-bearing article, assuring a controlled impedance of the terminations.

2. The interconnection arrangement of claim 1 wherein both ends of the conductive member are blade-like.

3. The interconnection arrangement of claim 1 wherein said conductive member is a loop antenna.

4. The interconnection arrangement of claim 1 wherein the arrangement further includes a housing in which the at least two terminals of the circuit-bearing article are disposed.

5. The interconnection arrangement of claim 1 wherein the circuit-bearing article includes two groups of terminals connected thereto, one group of terminals being electrically connected to one of the two termini, the other group of terminals being electrically connected to the other of the two termini, each group of terminals being adapted to engage one of the ends of the conductive member.

6. The interconnection arrangement of claim 5 wherein both ends of the conductive member are blade-like.

7. The interconnection arrangement of claim 6 wherein said conductive member is a loop antenna.

8. The interconnection arrangement of claim 2 wherein each of the blade-like ends of the conductive member extends at a right angle to the remaining portion of the conductive member.

9. The interconnection arrangement of claim 8 wherein said conductive member is a loop antenna.

10. The interconnection arrangement of claim 8 wherein the arrangement further includes a housing in which the at least two terminals of the circuit-bearing article are disposed.

11. The interconnection arrangement of claim 2 wherein the circuit-bearing article includes two groups of terminals connected thereto, one group of terminals being electrically connected to one of the two termini, the other group of terminals being electrically connected to the other of the two termini, each group of terminals being adapted to engage one of the ends of the conductive member.

12. The interconnection arrangement of claim 11 wherein each of the blade-like ends of the conductive member extends at a right angle to the remaining portion of the conductive member.

13. The interconnection arrangement of claim 12 wherein said conductive member is a loop antenna.

14. A method for connecting two ends of a conductive member to a circuit-bearing article resulting in a controlled impedance connection, comprising the steps of:

selecting a conductive member having two ends adapted to be mated to receptacles, the conductive member having a selected impedance;

selecting at least two terminals of heat-insensitive construction, each terminal having a connecting section for electrical connection to a circuit terminus of the circuit-bearing article and a receptacle adapted to engage one of the ends of the conductive member;

disposing a selected amount of a fluid conductive material on each the circuit terminus;

positioning the terminals on a respective terminus;

electrically connecting the connecting section of the terminals to a respective circuit terminus of the article; and mating the ends of the conductive member to respective ones of the receptacles;

whereby the conductive member is affixed to the circuit-bearing article after performance of processes involving elevated temperature to secure articles to the circuit-bearing article.

15. The method of claim 14 further including the step of positioning the terminals in a housing prior to mating the terminating sections to the ends of the conductive member.

16. The method of claim 14 further including positioning a group of terminals on each of the termini such that each group of terminals engages one of the ends of the conductive member.

17. The method of claim 15 further including positioning a group of terminals on each of the termini such that each group of terminals engages one of the ends of the conductive member.

* * * * *